United States Patent [19]

Galloway et al.

[11] Patent Number: 4,689,597

[45] Date of Patent: Aug. 25, 1987

[54] ELECTRICAL FUSE COMPONENT AND METHOD OF USING SAME

[75] Inventors: Michael D. Galloway, Middletown; David T. Shaffer, Harrisburg, both of Pa.

[73] Assignee: AMP Incorporated, Harrisburg, Pa.

[21] Appl. No.: 857,212

[22] Filed: Apr. 29, 1986

[51] Int. Cl.[4] ..... H01H 85/02; H01H 85/14

[52] U.S. Cl. ..... 337/186; 337/189; 337/256; 361/104; 29/623

[58] Field of Search ..... 337/11, 186, 187, 188, 337/189, 221, 216, 256; 361/104; 29/623

[56] References Cited

U.S. PATENT DOCUMENTS 4,483,064 11/1984 Bernstein ..... 29/623

4,547,830 10/1985 Yamauchi ..... 361/104

*Primary Examiner*—Harold Broome

*Attorney, Agent, or Firm*—Anton P. Ness

[57] ABSTRACT

An electrical component has a plurality of paired contacts with spaced inner contact sections bridged by a fuse element. The paired contacts have outer contact sections enabling mounting to a circuit panel to complete circuit paths thereon. The component is used as a fuse component to protect the circuit panel by preventing overload of a circuit path by the respective fuse element. When the circuit paths have different design in-service currents and different levels of excessive electrical currents, the corresponding fuse elements can have correspondingly different in-service current-carrying capabilities and different melting points, in the same component. The component can be surface mountable and can have DIP configuration.

20 Claims, 8 Drawing Figures

FIG. 1
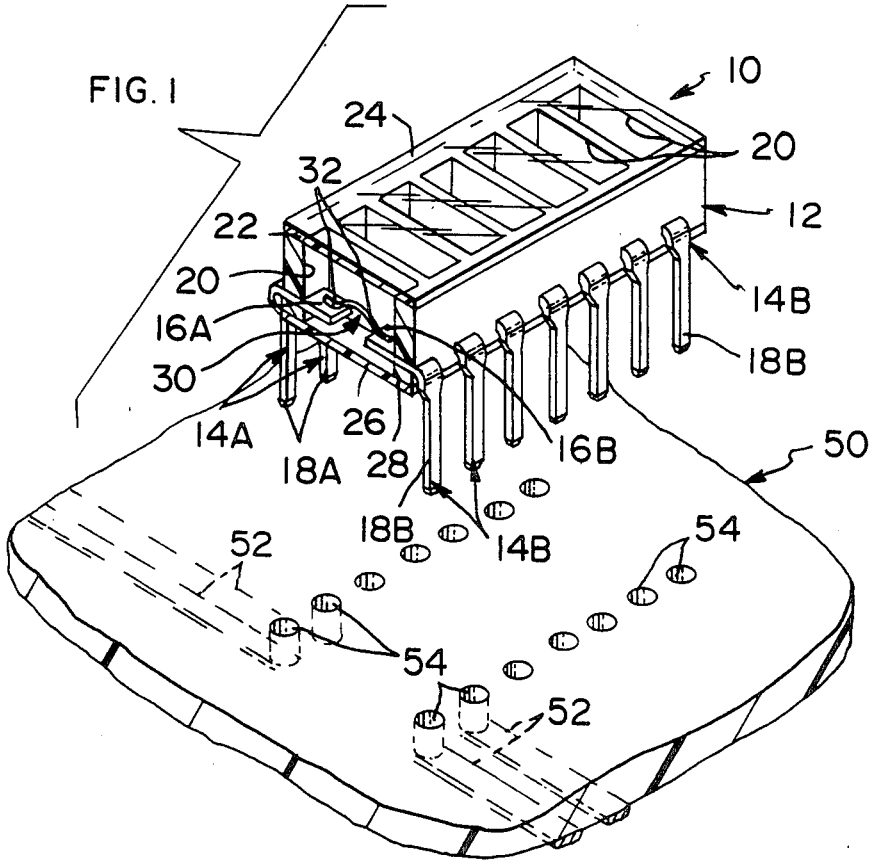
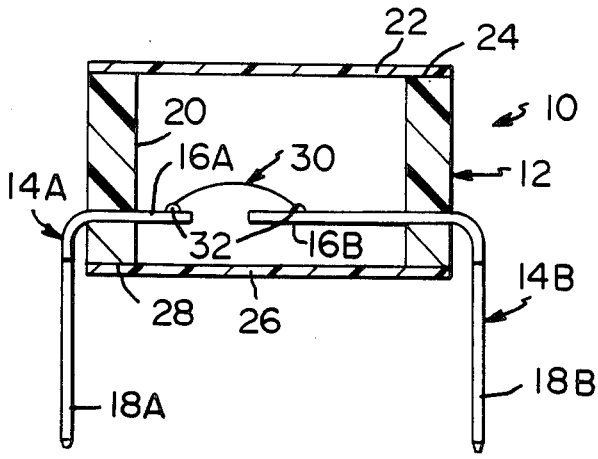
FIG. 2

40
42
44B
48B
44A
48A
46A
30
46B
60
64
62

ELECTRICAL FUSE COMPONENT AND METHOD OF USING SAME

The present invention is related to the field of electrical components, and more particularly is related to the field of components for circuit panels.

BACKGROUND OF THE INVENTION

Circuit paths of a circuit panel presently are protected in one manner against excessive electrical load by a fuse located in the power supply. It is a known problem that in such situations the circuit panel, or one of its paths, may receive an electrical load excessive to it which could not be protected against by the single fuse of the power supply, and the entire circuit panel becomes ruined and must be replaced. This is especially true where different paths of the same circuit panel have different design in-service load-carrying capabilities receiving voltage and current from the same power supply, such as −5 volts, +5 volts, +12 volts and +24 volts so on, and 1 ampere, 1.2 amperes, 3 amperes and 0.5 amperes. Another manner of protecting an individual circuit path presently known is by using a discrete fuse such as a Subminiature Picofuse (125 V), part number 275001 sold by Littelfuse, Inc. of Des Plaines, Ill. Such a fuse has pigtail leads allowing mounting to sockets of a circuit panel. Several circuit paths could be protected by a like plurality of such discrete fuses. But such fuses are relatively large considering the trend to very closely spaced centerlines such as 0.050 inches to conserve valuable real estate on a circuit panel.

It is desirable to provide a fuse component mountable to a circuit panel to protect a plurality of circuit paths, which component is disposable and replaceable upon fuse failure after receipt of an excessive electrical load, allowing continued use of the circuit panel. It is also desirable to provide one component to protect several circuit paths having different in-service and maximum loads.

SUMMARY OF THE INVENTION

The electrical fuse component used in the method of the present invention has pairs of contacts having outer contact sections electrically engageable with contact sections (such as sockets or conductive pads) of circuit paths of a circuit panel such as a circuit board or a flexible panel. Inner contact sections are in spaced pairs in respective cavities of the housing and are bridged by a fuse element secured thereto in electrical engagement therewith. The fuse element for each pair of contacts has a selected in-service current-carrying capability corresponding with that of the circuit path whose circuit it completes upon the component being secured to the circuit panel, and also has characteristics selected to cause opening of the fuse by melting upon receipt of an electrical current excessive either in level or duration or both.

According to the method of using the electrical component of the invention, the fuse component serves to protect the circuit paths of the circuit panel from excessive in-service electrical current. During normal in-service functioning the circuit panel has the fuse component mounted thereon bridging all of the circuit paths, and upon receipt of an electrical current excessive in level or duration on one of the circuit paths the fuse element normally completing the circuit of the one circuit path will melt and open, protecting the circuit panel and other electronic components on the circuit path. The entire fuse component is then removed and another is secured in its place.

One embodiment of the electrical fuse component of the present invention provides fuse elements having different selected in-service current-carrying characteristics and different melting points, corresponding to different in-service capabilities of the various circuit paths to be protected, and different currents deemed excessive in level or duration or both.

BRIEF DESCRIPTION OF THE DRAWINGS

FIG. 1 is a perspective view of the electrical component of the invention exploded from a printed circuit board with a housing end wall portion broken away.

FIG. 2 is a cross-sectional view taken along lines 2—2 of FIG. 1.

DETAILED DESCRIPTION OF THE INVENTION

Figure 3:
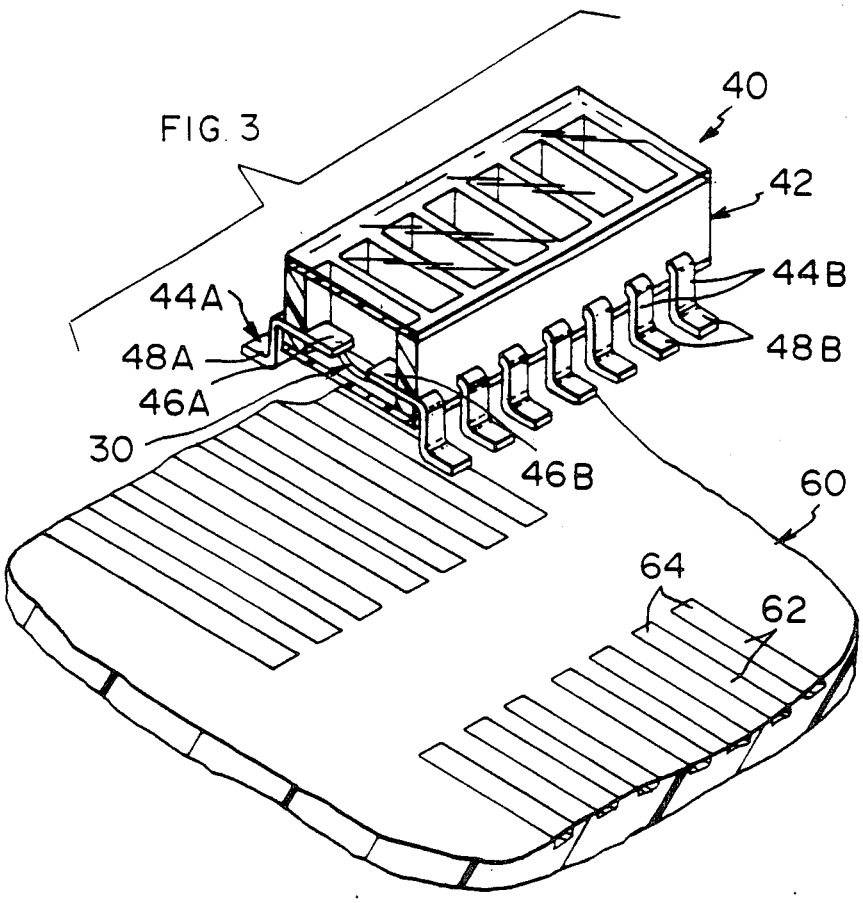
FIG. 3 is a perspective view showing a segment of a flexible circuit panel having conductive pads for surface mounting of another embodiment of the electrical component of the present invention.

FIGS. 1 and 2 show the electrical component 10 usable with the method of the present invention. Such an electrical component usable with the method of the present invention is disclosed in U.S. patent application Ser. No. 857,204 filed Apr. 29, 1986. Electrical component 10 has a housing 12 and a plurality of pairs of contacts 14A,14B spaced therealong preferably in a dual in-line arrangement. Each contact 14A has an inner contact section 16A spaced proximate an inner contact section 16B of its corresponding contact 14B. A fuse element 30 extends between the pair of inner contact sections 16A,16B and is mechanically secured thereto at joints 32 in electrical engagement therewith. Each of the pair of contacts 14A,14B also has an outer contact section 18A,18B respectively for electrical engagement with a corresponding contact means of an electrical circuit path on a circuit panel disposed in a component receiving region thereof. Inner contact sections 16A,16B are preferably disposed in respective cavities 20 of housing 12. The electrical component is preferably sealed by securing a sealing member 22 to the top 24 of housing 12 and a sealing member 26 to the bottom 28 of the housing. Outer contact sections 18A,18B are vertical leg sections for insertion into holes 54 which form part of the circuit paths 52 on a rigid circuit panel such as a printed circuit board 50 with paths 52 shown in phantom in FIG. 1 and disposed on the bottom surface of board 50. The fuse element 30 is preferably secured for performance reasons to the top surfaces of inner contact sections 16A,16B and arced upwardly away from the ends of the contact sections.

FIG. 3 illustrates an alternate embodiment where fuse element 30 is secured by joints 32 to bottom surfaces of the inner contact sections 46A,46B of contacts 44A,44B, in housing 42 of component 40. Because the walls of the housing must have a height sufficient to enable handling by automated handling apparatus for positioning on a circuit panel, it is easier during fabrication of the fuse shunt to secure the fuse element 30 to the bottom surfaces of contact sections 46A,46B which are proximate the bottom face of the fuse shunt. Contacts 44A,44B include outer contact sections 48A,48B which comprise a pair of coplanar horizontally extending sections, for surface mounting to conductive pads 64 of the circuit paths 62 on the top surface of a circuit panel such as flexible circuit panel 60.

The fuse element is secured to the inner contact sections such as by conventional resistance welding or wire bonding techniques to form joints 32. Another method of joining the fuse element is disclosed in U.S. patent application Ser. No. 857,209 filed Apr. 29, 1986. In that method the fuse element is a wire segment first disposed in a groove skived axially along the inner contact sections and then terminated by deforming portions of the inner contact sections forming sidewalls of the groove over the top of the wire at at least one location on each wire end section by means of a bifurcated terminating tool, or alternatively by a flat-ended terminating tool. Various methods based on conventional techniques may be used so long as heat is not generated in sufficient amounts to inadvertently open or damage the fuse element which is fragile requiring care in handling and processing.

Figure 4A:
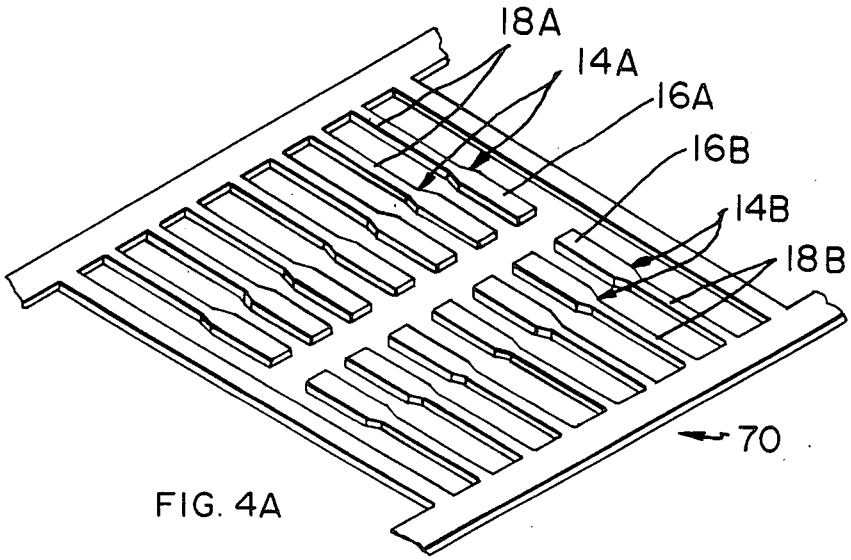
FIGS. 4A–4D are perspective views illustrating sequentially one method of making the electrical component of FIG. 1.
Figure 4B:
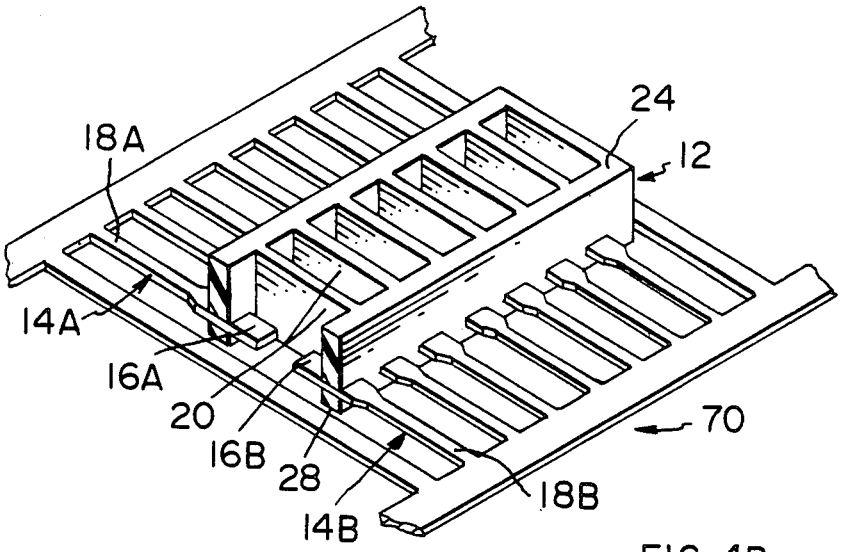
Figure 4C:
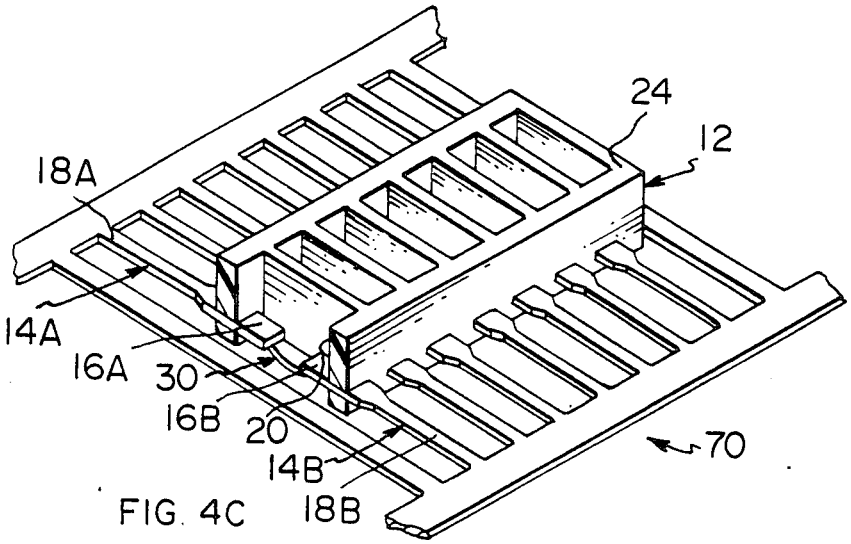
Figure 4D:
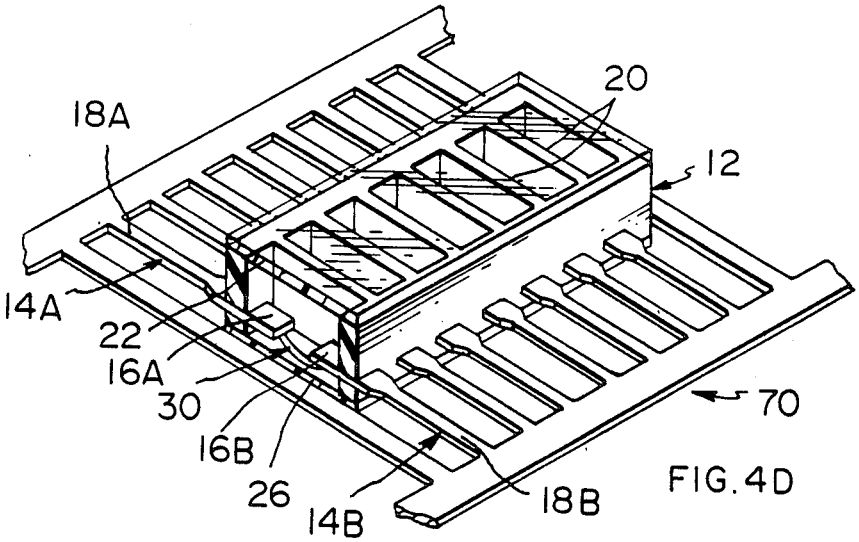

It is believed preferable to secure the fuse element to the pair of contact sections after first securing the contacts in the housing so that the housing provides mechanical stability and enhances physical protection of the fragile wire fuse element during fabrication as is shown in FIGS. 4A to 4C. While joined to a carrier strip 70, the contacts 14A,14B are preferably placed in a mold and a dielectric housing 12 molded thereto by conventional insert molding techniques as shown in FIG. 4B. Fuse elements 30 are then secured to respective contact sections as in FIG. 4C. Thin, transparent sealing membranes 22,26 are then preferably adhered to the top and bottom surfaces 24,28 respectively of housing 12 completing the manufacture of the electrical component as in FIG. 4D. The completed components can then be severed from the carrier strip and the outer contact sections 18A,18B formed into the desired configuration. The contacts 14A,14B are preferably stamped from a strip of copper alloy, and outer contact sections 18A,18B may be tin-lead plated for solderability. Housing 12 may be formed of a thermoplastic material such as glass-filled polyester resin. Sealing membranes 22,26 may be MYLAR (trademark of E. I. du Pont de Nemours and Company).

Fuse element 30 is preferably a wire segment of a selected very small diameter creating high resistance, and may be any of several conventional types of conductive metals such as high copper content alloy, aluminum, silver alloy, or constantan. The proper material to be used, and the actual diameter selected depend on the type of current desired to be carried by the fuse during normal in-service use and also the current deemed excessive for the circuit path, at which the fuse element is designed to open. For example, a satisfactory fuse element can be a short length of aluminum wire having a diameter of 0.0007 inches if it is desired that the fuse carry an in-service current of 0.1 amperes and open upon receiving a current of 1.0 ampere for 100 milliseconds or less. A satisfactory fuse element can be a short length of constantan alloy having a diameter of 0.0015 inches for the same in-service and excessive currents.

The fuse element opens by melting upon sufficient heat buildup resulting from occurrence of a designed excessive current passing through its very small diameter and limited length for a sufficient time. It is possible to estimate an appropriate small diameter for the fuse element after the following items are selected or determined: the excessive level of current ($I_e$) and duration of excessive current (t), length of the fuse (L), ambient temperature ($T_a$), and metal alloy being used for the fuse. Characteristic properties of the metal alloy are ascertained; melting temperature ($T_m$), specific heat (Cp), latent heat of fusion ($Q_f$), resistivity ($\rho$), and specific gravity (SG).

The heat required to melt the fuse is related to the fuse element dimensions and properties as follows:

$$\text{HEAT}=\text{MASS}\times[(T_m-T_a)Cp+Q_f] \quad (1)$$

where the mass of the fuse element is $$\text{MASS}=\left[\frac{\pi D^2}{2}\right][L]\,[SG]. \quad (2)$$

The power generated by the current through the fuse is:

$$\text{POWER}=I_e^2R \quad (3)$$

where $$R=\frac{\rho 4L}{\pi D^2} \quad (4)$$

and the power and heat to melt are related to each other as:

$$\text{HEAT}=\text{POWER}\times t \quad (5)$$

EXAMPLES

Where the metal alloy considered is constantan, its characteristic values are as follows:

TABLE 1

| | Constantan |
|---|---|
| SG (specific gravity) | 0.323 lb/ft$^3$ |
| $T_m$ (melting temperature) | 2210° F. |
| Cp (specific heat) | 0.098 Btu/lb/°F. |
| $Q_f$ (latent heat of fusion) | 100 Btu/lb |
| $\rho$ (resistivity) | 374 Ω mil$^2$/ft |

Typical values for the remaining variables relevant to the present invention and its purpose and typical enviroment, are:

TABLE 2

| | |
|---|---|
| t (duration of excessive current = until designed melting of fuse at $I_e$) | 100 milliseconds |
| L (fuse length) = | 0.10 inches |
| $T_a$ (ambient temperature) = | 75° F. |

Because adjacent contact structure at the terminations 32 of the ends of fuse element 30 is at theoretical ambient temperature, the contacts act as heat sinks and absorb some of the heat from the fuse element when current passes therethrough, effecting the occurrence of melting.

It was desired to find the satisfactory diameters of constantan alloy wires designed to melt upon receipt of electrical currents of 1.0 ampere and 2.0 amperes respectively for 100 milliseconds or less which would be typical excessive current levels and duration for circuit paths having designed in-service currents of 100 milliamperes and 200 milliamperes respectively while such fuse elements carry the designed in-service currents.

It is believed that satisfactory diameters for a constantan fuse element are:

Where $I_e=1.0$ ampere, $D_1=0.0015$ inches

Where $I_e=2.0$ amperes, $D_2=0.0021$ inches

It should be noted that fuse melting will also occur where over a long period of time, an electrical current is carried by the fuse element substantially higher than the in-service current which it is designed to carry but less than the current ($I_e$) at which it was designed to open or melt in 100 milliseconds or less. Values for such intermediate excessive current levels and time-to-melt are dependent on variables such as heat transfer, tolerances in wire diameter and length due to manufacturing and termination respectively, and surface contamination on the fuse element. Heat transfer refers to the removal or dissipation of heat being built up in the fuse element because of resistance during the receipt of electrical current, by reason of adjacent contact structure, nearby component structure and the circuit panel, and possible cooling procedures utilized on the circuit panel.

To avoid interfering with the opening of a fuse element, upon occurrence of the excessive current for which it was intended to melt, the element 30 should be preferably spaced away from the ends of the inner contact sections 16A,16B and also from any of the structure of the housing 12 or seals 22,26 which would act to dissipate heat otherwise needed to melt the fuse. The seals 22,26 serve to physically protect the fragile fuse elements 30, and contan any vapors given off during the fuse melting and avoid possible contamination of nearby circuitry or components outside of component 10.

Figure 5:
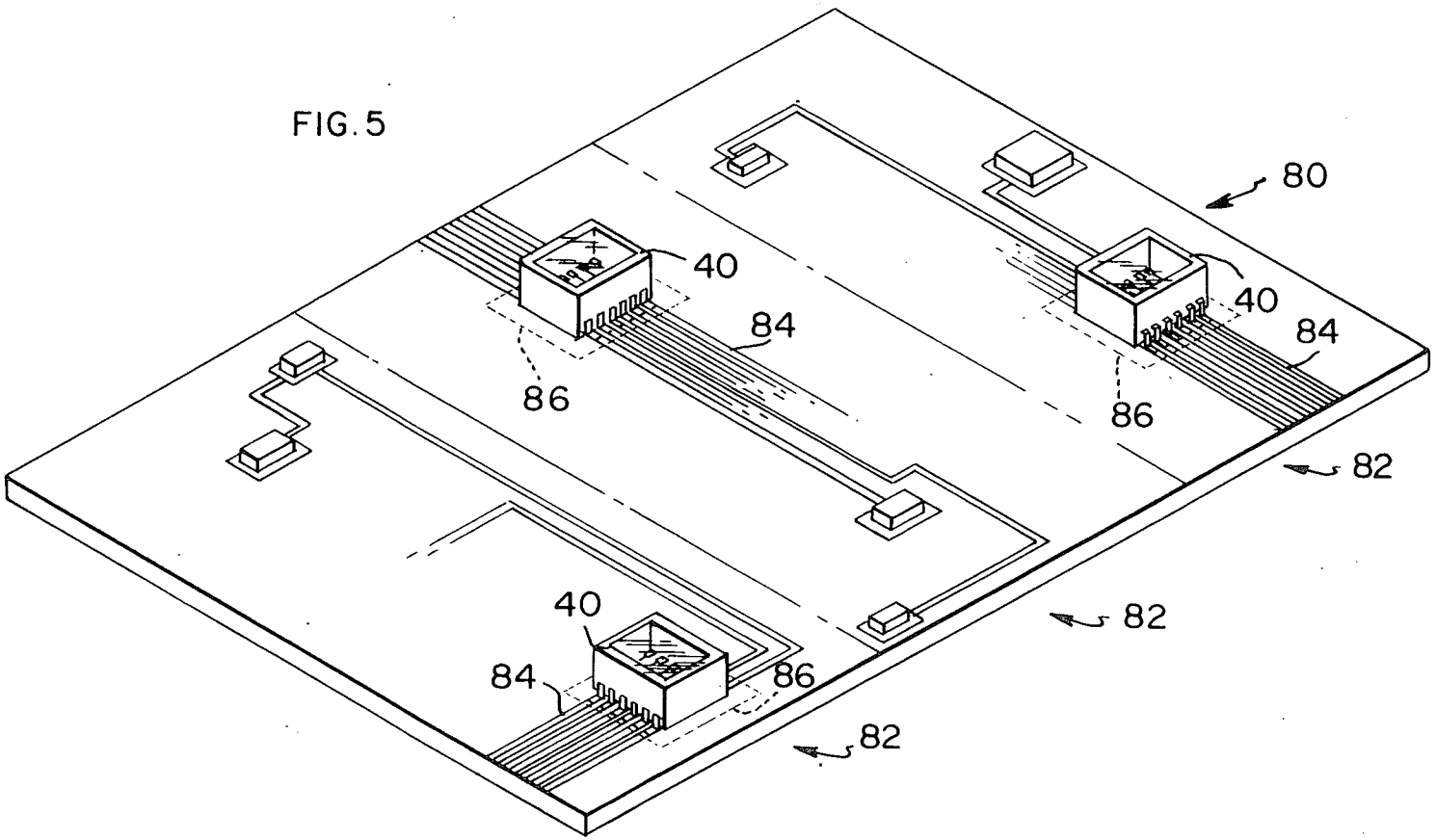
FIG. 5 is an illustration of a circuit panel having segments each having a separate component protecting its paths.

FIG. 5 illustrates a circuit panel 80 having several segments 82 each having a set of circuit paths 84. Separate components 40 are mounted to panel 80, one such component 40 completing the set of circuit paths 84 of each segment 82 at a component-receiving region 86 thereof. This arrangement allows for ease of adaptation of existing circuit configurations to accommodate the fuse components of the present invention.

What is claimed is:

1. An electrical component mountable to an electrical article to complete a plurality of circuit paths thereof, and removable therefrom, comprising:

a plurality of pairs of opposing contact means, each pair associated with a circuit path each of said contact means having an outer contact section matable to a corresponding contact means on said article and further having an inner contact section spaced from the inner contact section of the other of said contact means;

a dielectric housing means molded of synthetic resin to said plurality of pairs of opposing contact means such that said outer contact sections thereof extend outwardly from said housing means, said housing means including cavity means into which said inner contact sections extend; and a fuse element associated with each said pair of contact means mechanically and electrically secured to and between said inner contact sections thereof.

2. An electrical component as set forth in claim 1 wherein each said circuit path has a design in-service current-carrying capability, the associated said fuse element has current-carrying characteristics selected to fulfill said design path current-carrying capability and further has characteristics selected to cause fuse melting upon receipt of an excessive electrical current, whereby each said circuit path is protected from excessive electrical current.

3. An electrical component as set forth in claim 2 wherein each said fuse element has current-carrying characteristics and melting characteristics different from those of another said fuse element, whereby corresponding said circuit paths of said article having different design in-service current-carrying capabilities are protected by the same electrical component from excessive electrical current.

4. An electrical component as set forth in claim 1 wherein said outer contact sections are disposed in a dual in-line arrangement.

5. An electrical component as set forth in claim 1 wherein said outer contact sections are vertical legs disposed in parallel pairs for insertion into corresponding hole means of said article for electrical connection to respective contact means of circuit paths thereof.

6. An electrical component as set forth in claim 1 wherein said outer contact sections have horizontally extending sections for surface mounting to corresponding pad means of said circuit paths of said article.

7. An electrical component as set forth in claim 1 wherein said cavity means is sealed.

8. An electrical component as set forth in claim 1 wherein said cavity means comprises a plurality of cavities each associated with a said pair of contact means.

9. An electrical connection of an electrical article and an electrical fuse component for protecting electrical circuit paths of said article, comprising:

an electrical article having $\eta$ electrical circuit paths where $\eta$ is an integer greater than one, each of said paths having a design in-service electrical current-carrying capability and each of said paths having a spaced pair of path contact means adjacent a respective path discontinuity, said pairs of path contact means being arranged proximate such other; and an electrical fuse component including a housing means and $2\eta$ contacts secured therein arranged in $\eta$ pairs associated with said $\eta$ circuit paths of said article, each pair having opposed spaced contact sections electrically bridged by a respective fuse element and extending into cavity means of said housing means and spaced from surfaces thereof, each of said $\eta$ pairs of contacts having a pair of outer contact means extending outwardly of said housing means and electrically engaged with an associated said pair of path contact means whereby said pair of fuse-bridged contacts completes the circuit of the associated said circuit path;

each said fuse element having characteristics selected to provice a design in-service current-carrying capability and to melt upon receipt of an excessive electrical current whereby each said fuse element completes the electrical circuit of the associated said circuit path during normal in-service use, and breaks said electrical circuit by opening upon the occurrence of an excessive electrical current, thus protecting said circuit paths; and at least one of said electrical circuit paths has a different selected current-carrying capability from at least another of said electrical circuit paths, and a corresponding at least one said fuse element has characteristics different from at least another said fuse element associated with said at least another electrical circuit path, enabling melting due to different levels or durations of excessive electrical currents, or both.

10. An electrical connection as set forth in claim 9 wherein said pairs of path contact means are arranged in parallel rows and said pairs of outer contact means are disposed in a dual in-line arrangement.

11. An electrical connection as set forth in claim 9 wherein each of said pairs of path contact means is a pair of socket means, and each of said pairs of outer contact means is a pair of vertical leg means matable with said pair of socket means.

12. An electrical connection as set forth in claim 9 wherein each of said pairs of path contact means is a pair of conductive pads, and each of said pairs of outer contact means includes horizontally extending leg sections matable with corresponding said conductive pads by surface mounting.

13. An electrical connection as set forth in claim 9 wherein said electrical article is a circuit panel means.

14. An electrical connection as set forth in claim 13 wherein said circuit panel means is rigid.

15. An electrical connection as set forth in claim 13 wherein said circuit panel means is flexible.

16. An electrical connection as set forth in claim 13 wherein said circuit panel means is a segment of a circuit panel having multiple segments, said segment including said pairs of said path contact means of said $\theta$ circuit paths, and at least another of said multiple segments includes path contact means of other circuit paths.

17. An electrical component mountable to an electrical article to complete a plurality of circuit paths thereof, and removable therefrom, comprising:

a plurality of pairs of opposing contact means, each pair associated with a circuit path of said article, each of said contact means having an outer contact section matable to a corresponding contact means on said article and further having an inner contact section spaced from the inner contact section of the other of said contact means;

a fuse element associated with each said pair of contact means mechanically and electrically secured to and between said inner contact sections thereof; and housing means secured to said plurality of pairs of contact means and including dielectric means at least adjoining said contact means, said housing means having cavity means such that said inner contact sections of said pairs of contact means extend thereinto spaced from surface portions of said housing means.

18. A method of making an electrical component mountable to an electrical article to complete a plurality of circuit paths thereof comprising the steps of:

selecting a plurality of contact means having inner and outer contact sections in an arrangement of opposing pairs where the inner contact sections of each pair of contact means are spaced and proximate each other;

molding a dielectric housing to said plurality of contact means with said inner contact sections extending into cavity means of the housing and said outer contact means extend outwardly from said housing; and securing a fuse element to respective said inner contact sections of each said pair of contact means.

19. A method as set forth in claim 18 comprising the further step of securing sealing membrane means to said housing enclosing said cavity means.

20. A method as set forth in claim 18 wherein said plurality of contact means are affixed to a carrier strip, and said contact means are severed from said carrier strip after said housing and said fuse elements are secured to said contact means.

* * * * *

UNITED STATES PATENT OFFICE

CERTIFICATE OF CORRECTION

Patent No. 4,689,597 Dated August 25, 1987

Inventor(s) Michael D. Galloway, et al.

It is certified that error appears in the above-identified patent and that said Letters Patent are hereby corrected as shown below:

Claim 1, line 5, a comma should be added after "path".

Claim 16, line 4, "$\theta$" should be ---$\eta$---.

Signed and Sealed this

Nineteenth Day of January, 1988

*Attest:*

DONALD J. QUIGG

*Attesting Officer*

*Commissioner of Patents and Trademarks*